US006408665B1

(12) United States Patent
Nishino et al.

(10) Patent No.: US 6,408,665 B1
(45) Date of Patent: Jun. 25, 2002

(54) FINISH HOT ROLLING METHOD FOR STRUCTURAL STEELS

(75) Inventors: Junji Nishino; Koichi Hasegawa; Akira Terashima, all of Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/743,307

(22) PCT Filed: Aug. 9, 2000

(86) PCT No.: PCT/JP00/05341

§ 371 (c)(1),
(2), (4) Date: Jan. 8, 2001

(87) PCT Pub. No.: WO01/10578

PCT Pub. Date: Feb. 15, 2001

(30) Foreign Application Priority Data

Aug. 9, 1999 (JP) ..... 11-225708

(51) Int. Cl.[7] ..... B21B 13/12
(52) U.S. Cl. ..... 72/235; 72/366.2
(58) Field of Search ..... 72/234, 235, 365.2, 72/366.2

(56) References Cited

U.S. PATENT DOCUMENTS 4,907,438 A * 3/1990 Sasaki et al. ..... 72/235
5,442,946 A * 8/1995 Yokoo et al. ..... 72/235

FOREIGN PATENT DOCUMENTS

JP 4-288904 10/1992
JP 7-173530 * 7/1995 ..... 72/235
JP 9-122726 5/1997

* cited by examiner

*Primary Examiner*—Ed Tolan
(74) *Attorney, Agent, or Firm*—Kenyon & Kenyon

(57) ABSTRACT

The present invention provides a finish hot rolling method for structural steels capable of realizing enhanced dimensional accuracy and a uniform microstructure, using a 2-stand 3-roll finishing mill, wherein an area reduction rate of the final finishing pass is 10 to 20% and the value of an area reduction rate of the final finishing pass divided by the corresponding area reduction rate of the pass preceding the final finishing pass is 0.7 to 1.3.

5 Claims, 9 Drawing Sheets

FINISH HOT ROLLING METHOD FOR STRUCTURAL STEELS

This application is a 35 USC 371 of Pct JP00/05341 filed Aug. 9, 2000.

DESCRIPTION

1. Field of Art

The present invention relates to a finish hot rolling method for structural steels and, more specifically, to a hot rolling method capable of precision rolling steel bars, wire and rods.

1. Background Art

A known method to finish hot roll structural steels with high dimensional accuracy comprises application of a light area reduction rate of 10% or less at a finish rolling pass to suppress pass spreading. According to "Precision Rolling Method of Structural Steels" disclosed in Japanese Unexamined Patent Publication No. H4-371301, for example, when finish rolling structural steels by hot rolling, a heavy area reduction rate of 10% or more is applied at a rolling pass before a finish rolling pass and a light area reduction rate below 10% is applied at the finish rolling pass. Further, according to "Continuous Hot Rolling Method of Long Structural Steels" disclosed in Japanese Patent No. 2857279, a very light area reduction rate of 20% or less of a total area reduction rate of all post-finish rolling passes is applied at the final pass of the post-finish rolling. Both the rolling methods for structural steels, disclosed in the above two publications, aim at suppressing abnormal grains by accumulating strain through successive rolling passes. When the distances between roll stands are long or the rolling speed is slow, however, it is difficult to accumulate strain and therefore it is impossible to suppress the occurrence of abnormal grains. In addition, although the proposed methods can suppress the occurrence of large grains, because of the light area. reduction at the finish rolling pass it is difficult to refine crystal grains to the extent that they do not require normalizing or other heat treatments.

Some technologies employ 3-roll mills for finish rolling of structural steels. For example, according to "Sizing Rolling Method of Steel Bars, Wire and Rods" disclosed in Japanese Examined Patent Publication No. H3-50601, sizing rolling from a material diameter to the diameter of 85% of the material diameter is conducted using two 3-roll mills. Also, according to "Free Size Rolling Method of Steel Bars, Wire and Rods" disclosed in Japanese Unexamined Patent Publication No. H7-265904, sizing rolling from a material diameter to the diameter of 95% of the material diameter is conducted using three 3-roll mills. Both rolling methods of steel bars, wire and rods disclosed in the above publications do not disclose any rolling method to achieve good dimensional accuracy and to prevent abnormal microstructures at the same time. It is impossible to obtain a target product diameter by the sizing rolling method of the Japanese Examined Patent Publication No. H3-50601 because, according to the method, the arc diameter of a roll caliber for the final finishing pass is larger than the target diameter of the corresponding product. Using the free size rolling method of the Japanese Unexamined Patent Publication No. H7-265904, it is impossible to obtain both dimensional accuracy and uniform microstructures at the same time.

DISCLOSURE OF THE INVENTION

The object of the present invention is to provide a hot rolling method, for structural steels, capable of both enhancing dimensional accuracy and of homogenizing the microstructure.

The finish hot rolling method for structural steels according to the present invention uses a 2-stand 3-roll finishing mill and is characterized in that an area reduction rate of the final finishing roll pass of the mill is 10 to 20% and that the value of an area reduction rate of the final finishing pass divided by the corresponding area-reduction rate of the roll pass preceding the final finishing pass is 0.7 to 1.3.

Using the present invention, it is possible to minimize pass spreading in a rolling pass since it uses a 3-roll rolling method. It is also possible, according to the present invention, to obtain a uniform microstructure, without depending on an accumulated strain, by setting an area reduction rate of the final finishing pass at 10 to 20%. By setting the value of an area reduction rate of the final finishing pass divided by the corresponding area reduction rate of the preceding pass to 0.7 to 1.3, it is possible to apply an area reduction rate as high as 10% or larger at the final finishing pass without deteriorating product dimension accuracy.

In the finish hot rolling method for structural steels described above, it is preferable that the arc radius of a roll caliber of the preceding pass is 1.0 to 1.3 times the arc radius of the corresponding roll caliber of the final finishing pass. This makes high precision finish rolling of steel products viable.

It is also preferable to form a caliber of the final finishing pass such that the arc radius is equal to the target radius of the corresponding product, the central angle of the arc is 90 to 100°, and a side wall portion at each side of the caliber extends in a straight line from an end of the arc portion to a roll shoulder. This makes it possible to obtain high dimension accuracy even when applying a high area reduction rate of 10% or larger at the final finishing pass. Dimension accuracy is enhanced also by the fact that the portions of rolled products reduced at the preceding pass are reduced again at the final finishing pass.

When finish rolling is done at a steel temperature of 700 to 800° C. at the entry side of the finishing mill in the finish hot rolling method for structural steels described above, an austenite crystal grain size number of No. 8 or better under the Japanese Industrial Standard is achieved and normalizing and other heat treatments can be eliminated thereby.

It is also acceptable to provide a 3-roll mill comprising 2 or more stands in front of the finishing mill, apply a total area reduction rate of 30% or more through all the roll stands, and control the steel temperature at the entry side of the finishing mill to 700 to 900° C. This makes the crystal grain of the steel material fed to the 2-stand 3-roll finishing mill finer, and precision finish rolling viable, to obtain structural steels having uniform sectional microstructure and refined crystal grains, allowing elimination of normalizing and other heat treatments.

BEST EMBODIMENT FOR CARRYING OUT THE INVENTION

According to the present invention, structural steels are finish hot rolled by a 2-stand 3-roll finishing mill, wherein roll passes consist of the final finishing pass and the pass preceding it. In the finish hot rolling, the area reduction rate of the final finishing pass is set to 10 to 20% and a relative area reduction ratio (the area reduction rate of the final finishing pass divided by the corresponding area reduction rate of the preceding pass) to 0.7 to 1.3.

Figure 1:
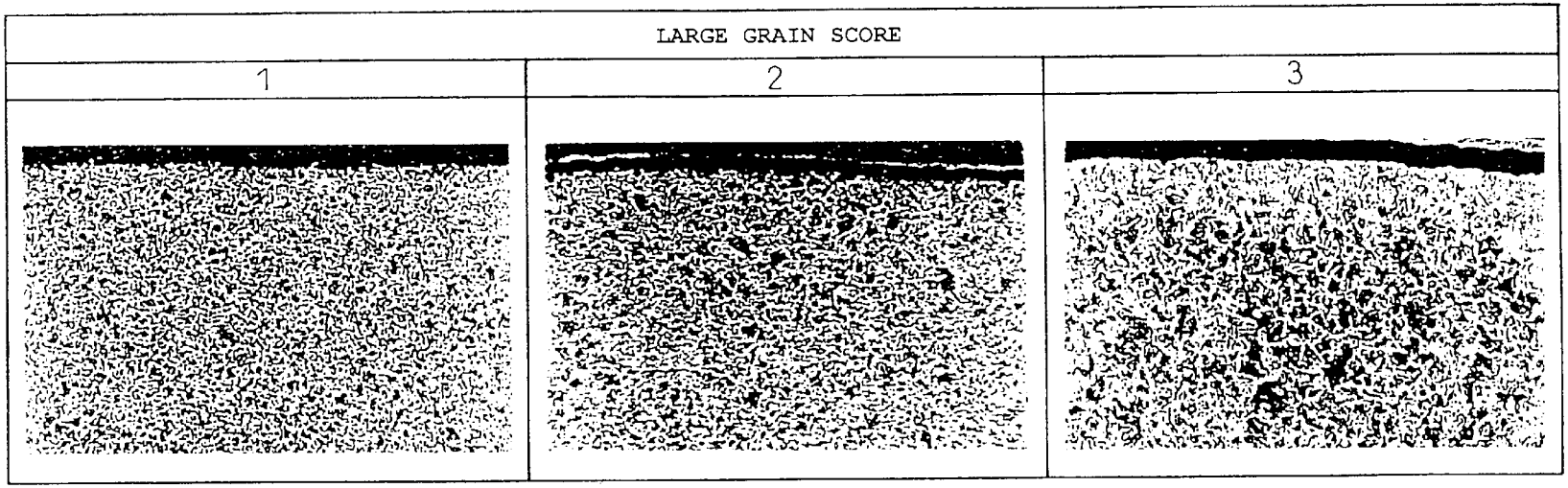
FIG. 1 consists of photomicrographs showing metallographic structures corresponding to the large grain scores of 1, 2 and 3, respectively.
Figure 2:
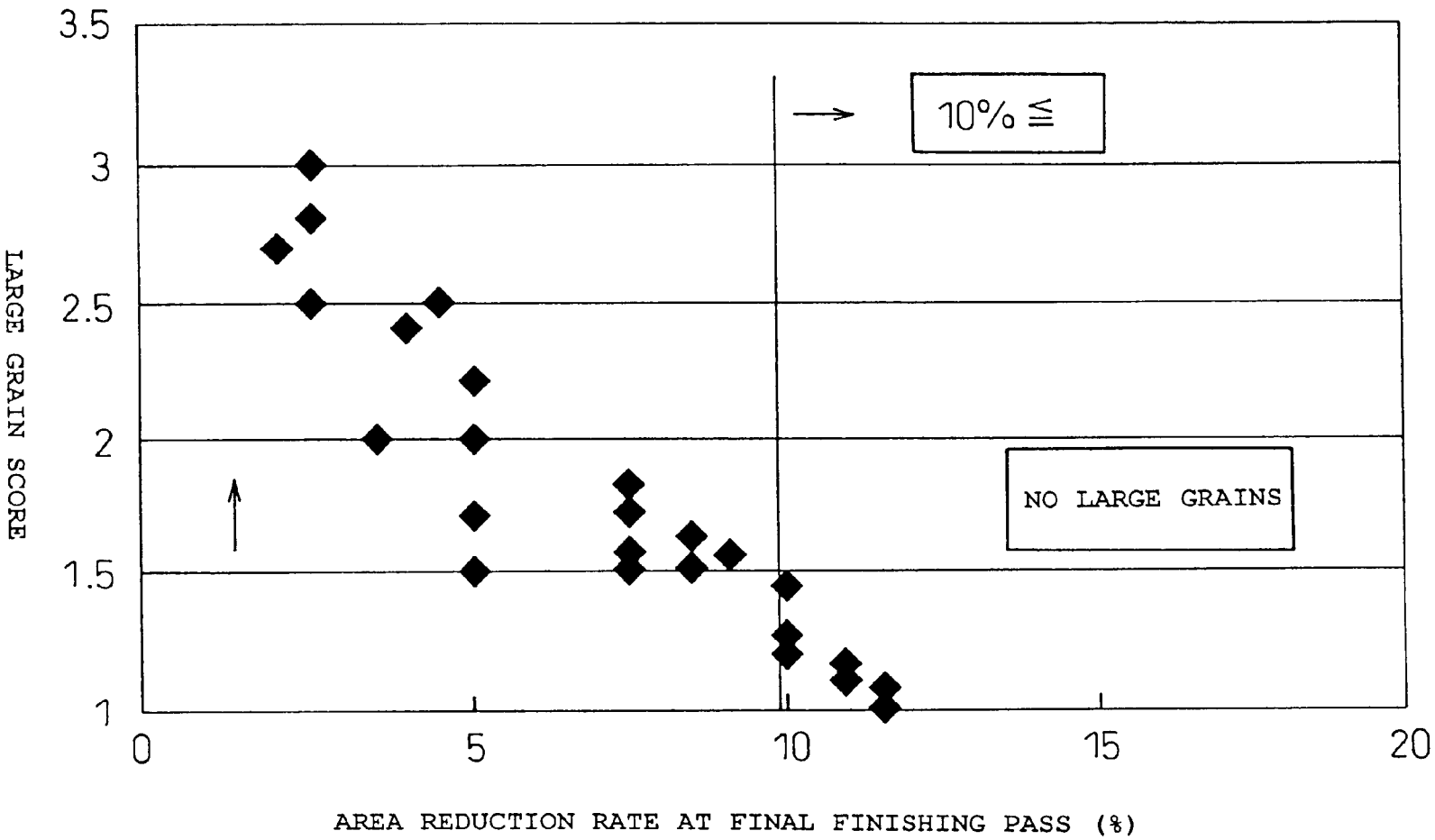
FIG. 2 is a graph showing the relationship between the large grain score and the area reduction rate at the final finishing pass.

FIG. 2 shows the relationship between the large grain score and the area reduction rate of the final finishing pass obtained through tests on a commercial production facility. In the tests, materials of a steel grade of JIS S45C were rolled into bars under the condition of a diameter of 45 mm and a temperature of 900 to 950° C. at the entry side of the finishing mill. FIG. 1 shows metallographic structures of the large grain scores of 1, 2 and 3, respectively. The large grain score of 1.0 means that absolutely no large grains are observed, and 1.5 is the value of a permissible limit. FIG. 2 shows that the occurrence of large grains is controlled within the permissible limit by setting the area reduction rate of the final finishing pass to 10% or higher. Note that, when the area reduction rate of the final finishing pass exceeds 20%, the area reduction rate of the preceding pass has to be raised, but this causes the formation of acute angles in the section of the corners of the material rolled at the preceding pass and the material does not enter the final finishing pass.

Table 1 shows the relationship between the relative area reduction ratio and forming performance obtained through tests on a commercial production facility. The material and the steel temperature at the entry side of the finishing mill employed in these tests on a commercial production facility were the same as those of FIG. 2 employed in the tests on a commercial production facility. In the table, test No. 2 represents the cases according to the present invention with the relative area reduction ratio ranging from 0.7 to 1.3. The forming performance of the entire test rolling operations under this condition was within a permissible range. In test No. 1, where the relative area reduction ratio was 1.4, over-fill was observed in the sectional shape of products after the final finishing pass and dimension accuracy was outside the permissible limit. In test No. 3, on the other hand, where the relative area reduction ratio was. 0.6, under-fill occurred at the final finishing pass.

TABLE 1

| NO. | AREA REDUCTION RATE AT FINAL FINISHING PASS / AREA REDUCTION RATE AT PRECEDING PASS | ALLOCATION OF AREA REDUCTION RATE: PRECEDING PASS | ALLOCATION OF AREA REDUCTION RATE: FINAL FINISHING PASS | PRODUCT SHAPE: FORMING PERFORMANCE | PRODUCT SHAPE: DIMENSION ACCURACY |
|---|---|---|---|---|---|
| 1 | 10%/7.1% = 1.4 | IN-COMING STEEL MATERIAL 7.1% 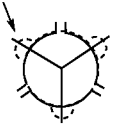 | OCCURRENCE OF OVER-FILL 10% 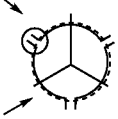 IN-COMING STEEL MATERIAL | OCCURRENCE OF PRODUCT OVER-FILL FROM CALIBER | OCCURENCE OF OVER-FILL |
| 2 | 10%/7.7% = 1.3~ 10%/14% = 0.7 | 7.7% ~ 14% IN-COMING STEEL MATERIAL 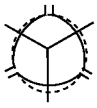 | 10% 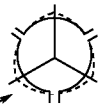 IN-COMING STEEL MATERIAL | FORMING VIABLE | CONTROLLED WITHIN = 0.1 mm |

TABLE 1-continued

| NO. | AREA REDUCTION RATE AT FINAL FINISHING PASS AREA REDUCTION RATE AT PRECEDING PASS | ALLOCATION OF AREA REDUCTION RATE: PRECEDING PASS | ALLOCATION OF AREA REDUCTION RATE: FINAL FINISHING PASS | PRODUCT SHAPE: FORMING PERFORMANCE | PRODUCT SHAPE: DIMENSION ACCURACY |
|---|---|---|---|---|---|
| 3 | 10%/16.7% = 0.6 | IN-COMING STEEL MATERIAL 16.7% 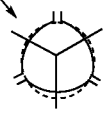 | OCCURRENCE OF UNDER-FILL 10% 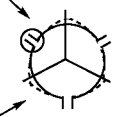 IN-COMING STEEL MATERIAL | OCCURRENCE OF STEEL MATERIAL UNDER-FILL IN FINAL FINISHING PASS | DIAMETER DEVIATION CONTROLLED WITHIN = 1.5% |

The above results indicate that it is necessary to set the area reduction rate of the final finishing pass to 10 to 20% and the relative area reduction ratio to 0.7 to 1.3 in order to obtain good dimension accuracy together with uniform microstructure.

Figure 3:
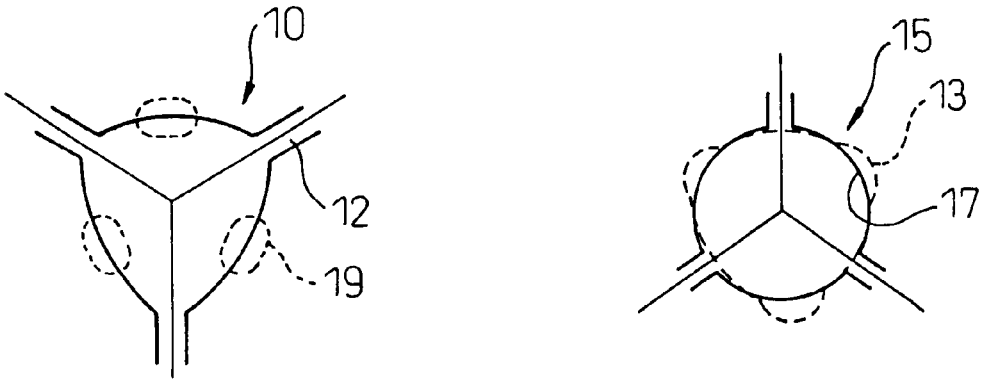
FIG. 3 consists of drawings schematically showing a roll caliber of the roll pass preceding the final finishing pass and a roll caliber of the final finishing pass.

FIG. 3 schematically shows a preceding pass caliber 10 and a final finishing pass caliber 15. The arc radius in the preceding pass caliber 10 is larger than that in the final finishing pass caliber 15, and the final finishing pass caliber 15 is arranged at 180° in relation to the preceding pass caliber 10. By this arrangement, a portion 13 corresponding to a gap 12 between the rolls in the preceding pass caliber 10 is reduced at the final finishing pass by a center portion 17 of a roll. Considering the fact that the shape of a preceding pass caliber is imprinted in the product portions not reduced by the final finishing pass caliber, the preceding pass caliber shape is of critical importance.

Figure 4A:
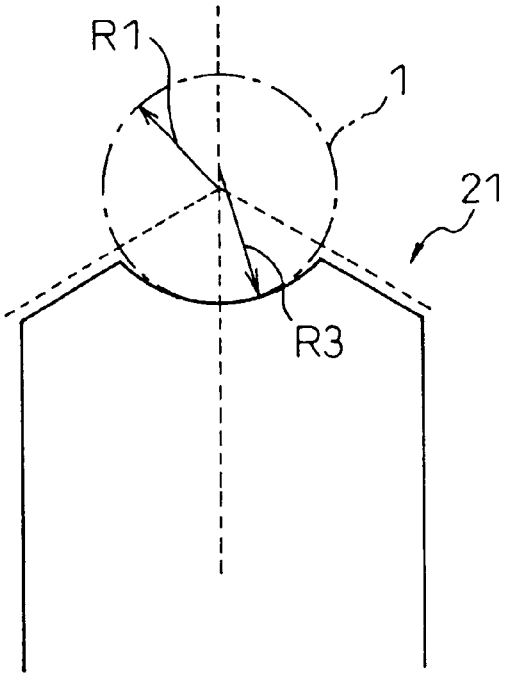
FIGS. 4(*a*) and 4(*b*) are sectional views, respectively, of a caliber roll of the preceding pass and that of the final finishing pass.
Figure 4B:
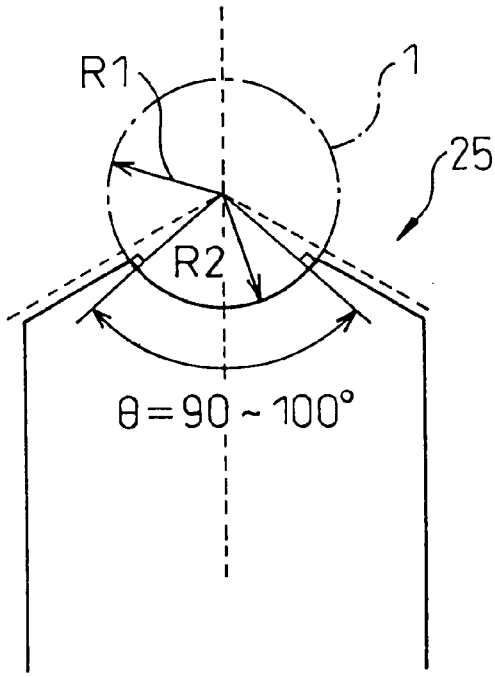

FIG. 4(*a*) shows a preceding pass caliber roll 21, and FIG. 4(*b*) a final finishing pass caliber roll 25. $R_1$ in the figure is a target radius of a rolled product 1. By the present invention, it is possible to further enhance dimension accuracy of the product by specifying the caliber dimensions and shapes of the preceding and the final finishing passes. Namely, it is preferable to shape the calibers such that the arc radius $R_3$ of a caliber of the preceding pass is 1.0 to 1.3 times the arc radius $R_2$ of the corresponding caliber of the final finishing pass.

Figure 5:
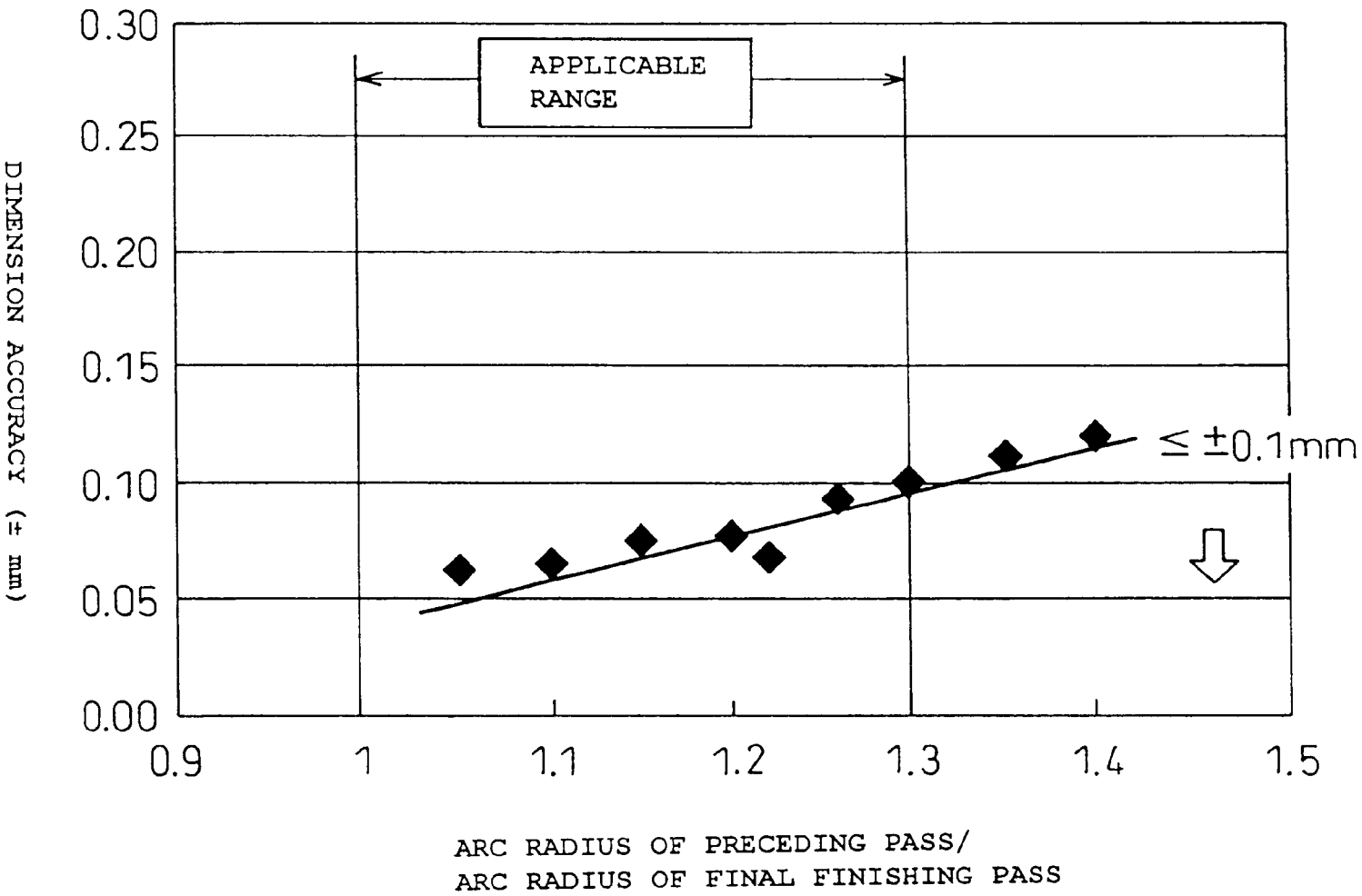
FIG. 5 is a graph showing the relationship between dimension, accuracy and a caliber arc radius ratio.

FIG. 5 shows the relationship between dimensional accuracy and a caliber arc radius ratio (the arc radius $R_3$ of a caliber of the preceding pass divided by the arc radius $R_2$ of the corresponding caliber of the final finishing pass) obtained through tests in a commercial production facility. When the arc radius $R_2$ of a caliber of the final finishing pass is larger than the arc radius $R_3$ of a caliber of the preceding pass, the sectional area of steel materials cannot be reduced while securing a proper shape. For this reason the caliber arc radius ratio must always be 1 or larger. According to FIG. 5, dimensional deviation can be controlled within a permissible limit of 0.1 mm or less when the caliber arc radius ratio is set to 1.3 or less.

Figure 6:
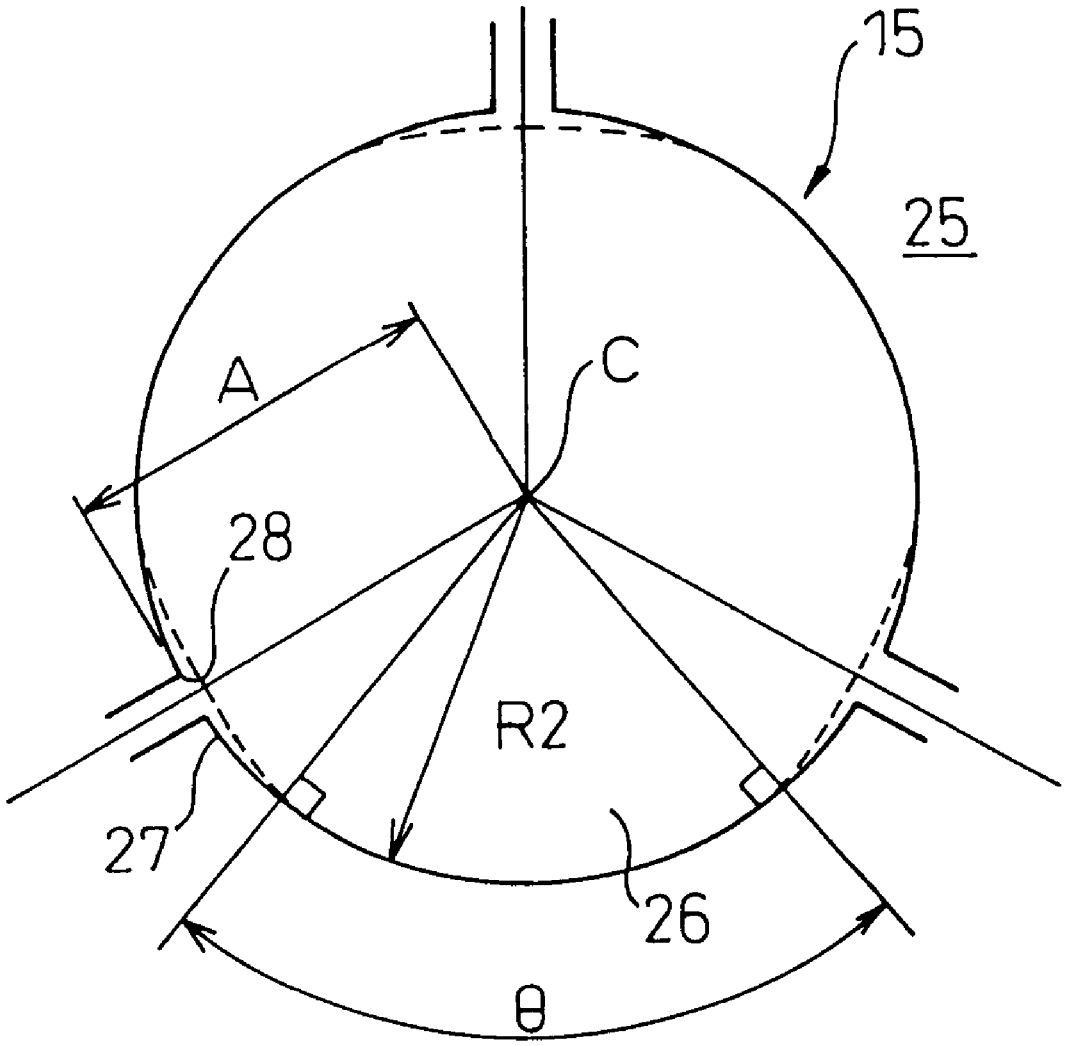
FIG. 6 is a detail drawing of a caliber roll of the final finishing pass.

It is preferable, for enhancing dimensional accuracy, to make the arc radius $R_2$ of a caliber of the final finishing pass equal to the target radius $R_1$ of a rolled product, even when the area reduction rate of the final finishing pass is as high as 10% or more. It is preferable, theoretically, to form an entire roll caliber in an arc and make its radius equal to the target radius $R_1$ of a product. However, an actual rolling operation involves pass spreading in rolling passes depending on changes in material temperature and steel grade. For the purpose of absorbing fluctuation of the pass spreading, the present invention provides, on each side of an arc portion 26, a side wall portion 27 extending from an end of the arc portion 26 to a roll shoulder 28 along the tangent at the end of the arc portion, as shown in FIG. 6, and the shoulder radius A (distance between the center C of the arc and the shoulder) is made slightly larger than the arc radius $R_2$ by a smallest possible extent. Note that the linear side wall portions cover the material portions reduced at the preceding pass (indicated by reference numeral 19 in FIG. 3) to form bar, wire and rod products having good dimension accuracy.

Figure 7:
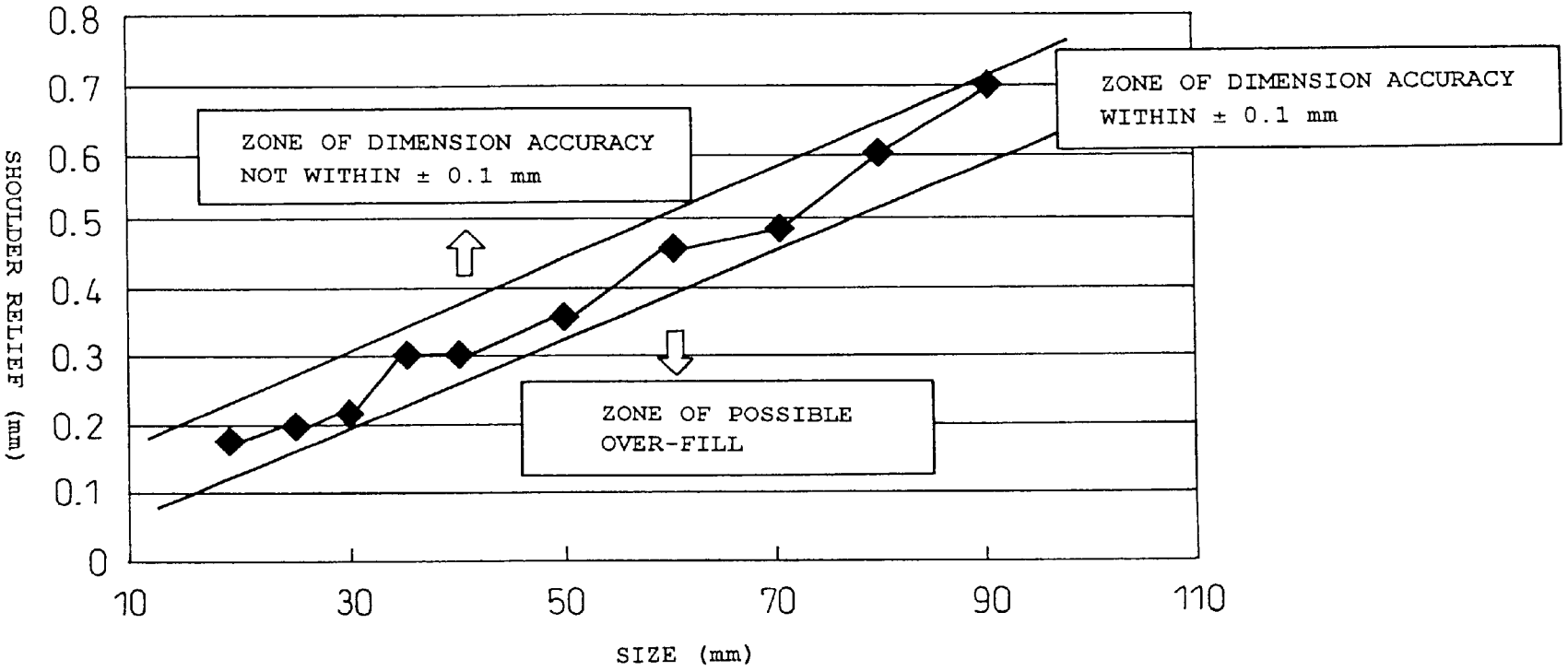
FIG. 7 is a graph showing the relationship between the amount of relief at roll shoulders and the diameter of rolled materials.
Figure 8:
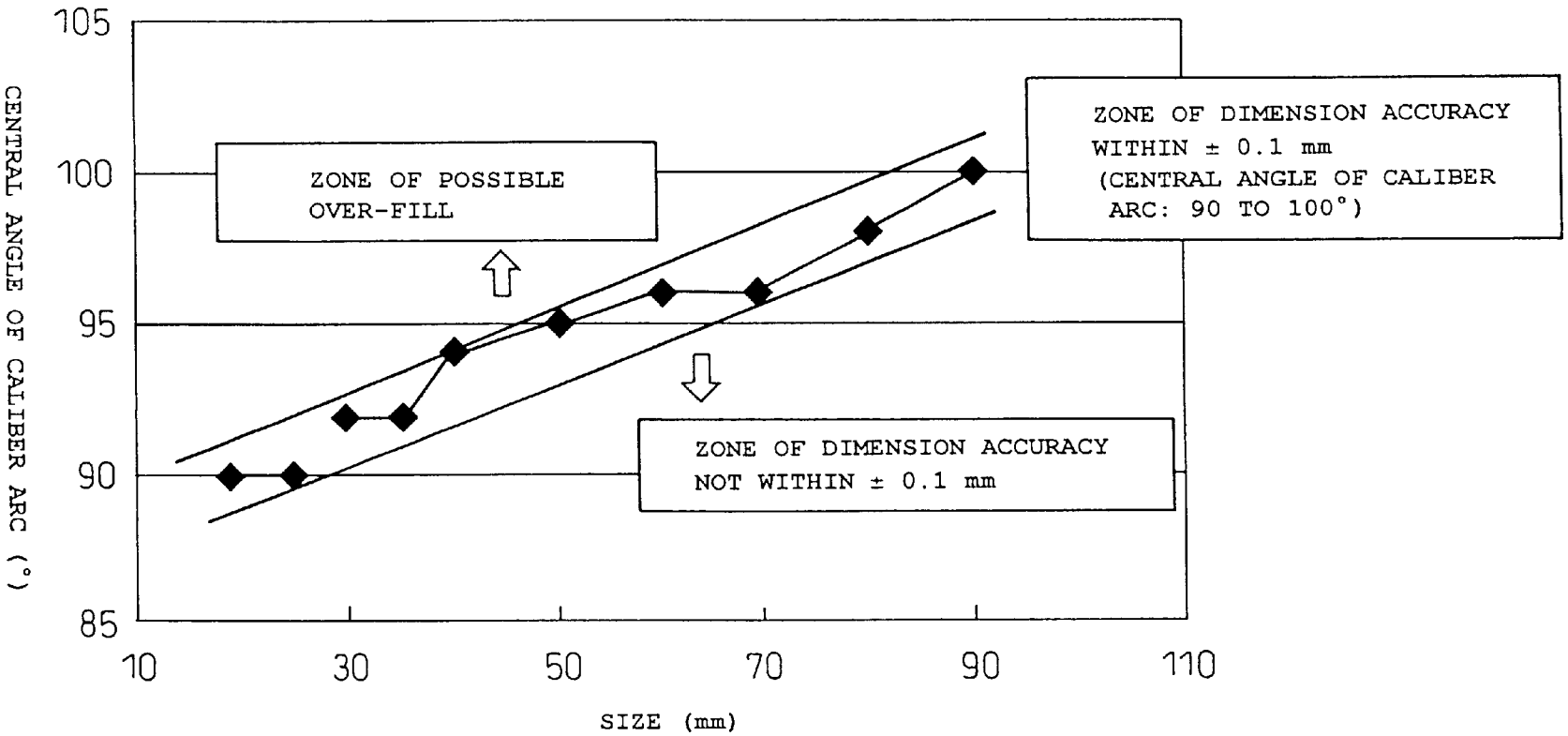
FIG. 8 is a graph showing the relationship between the central angle of a roll caliber arc and the diameter of rolled materials.

An appropriate value of the shoulder radius A for eliminating over-fill and minimizing size deviation can be defined by obtaining the value of a relief δ at the shoulder through tests. The value of the shoulder relief δ is defined as the shoulder radius A minus the arc radius $R_2$. The value of an appropriate shoulder relief δ, which depends on the target radius $R_1$ of a rolled product (which is equal to the arc radius $R_2$ of a caliber of the final finishing pass), is shown in FIG. 7 as obtained through tests. The required central angle θ of the arc portion can be calculated geometrically from the shoulder radius A obtained from the shoulder relief δ and the arc radius $R_2$. FIG. 8 shows that the appropriate arc central angle θ calculated as above ranges from 90 to 100°.

When the steel temperature at the entry side of the finishing mill is controlled within a range of 700 to 800° C. in the above finish rolling method, a microstructure having an austenite crystal grain size number of No. 8 or better, under the Japanese Industrial Standard, and uniformly refined grains can be obtained, allowing elimination of normalizing and other heat treatments.

Figure 9:
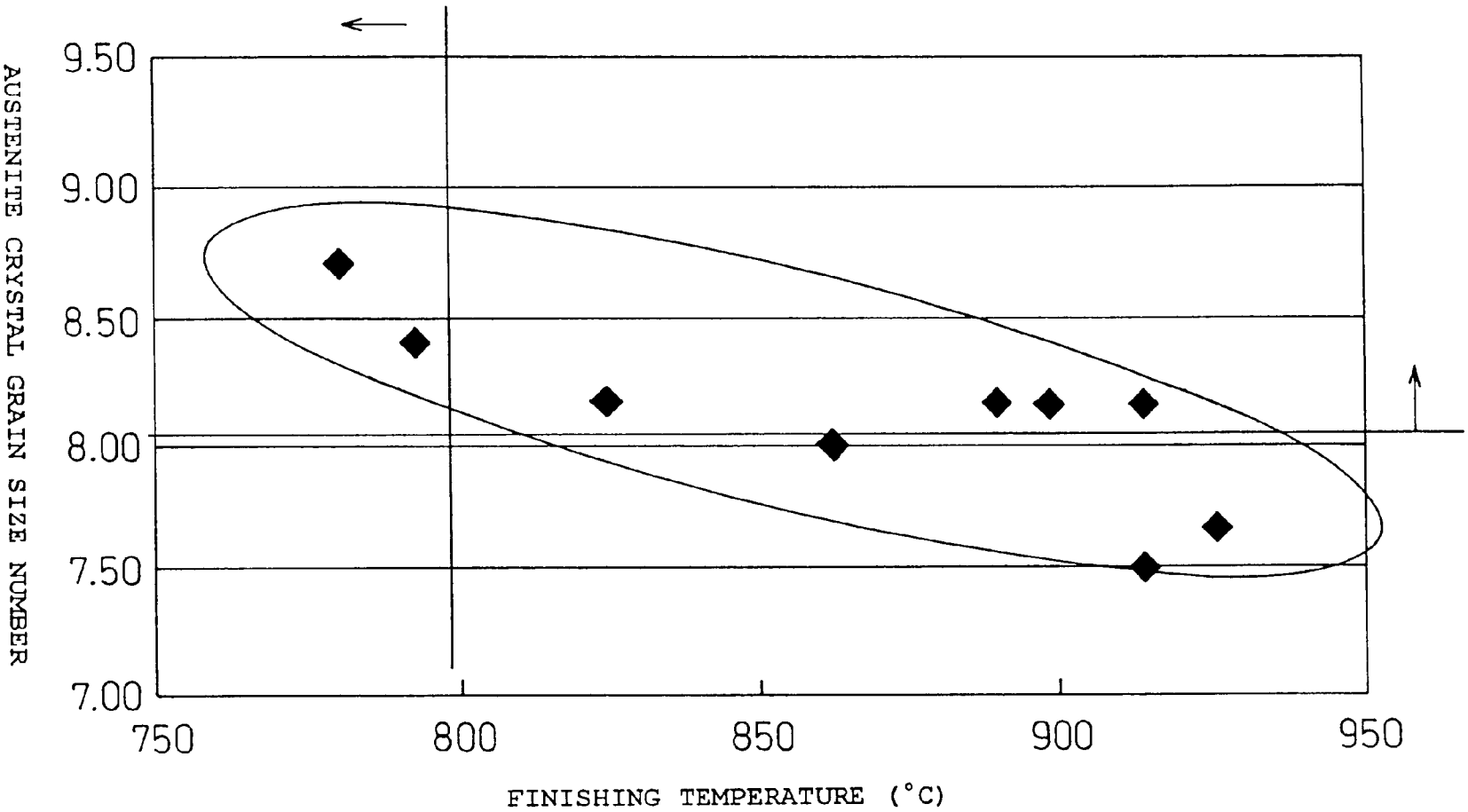
FIG. 9 is a graph showing the relationship between the austenite crystal grain size number and the steel temperature at the entry side of a finishing mill.

FIG. 9 shows the relationship between the austenite crystal grain size number and the steel temperature at the entry side of a finishing mill obtained through tests in a commercial production facility. In the tests, materials of a steel of grade S45C under the Japanese Industrial Standard having a diameter of 45 mm at the entry side of the finishing mill were rolled through the preceding and the final finishing passes under an area reduction rate of 10% each. According to FIG. 9, it is possible to achieve an austenite crystal grain size number of No. 8 or better, under the Japanese Industrial Standard, by controlling the steel temperature at the entry side of the finishing mill within a range of 700 to 800° C. Note that when the steel temperature at the entry side of the finishing mill falls below 70° C., there will be problems such as material defects and poor rolling behavior (increased rolling load, difficulty in getting into a rolling pass, etc.).

In the above finish rolling method, a uniform microstructure having an austenite crystal grain size distribution similar to the above can be obtained also by providing a 3-roll mill consisting of 2 or more roll stands in front of the finishing mill, applying the total area reduction rate of 30% or more through all the roll stands, and controlling steel temperature at the entry side of the finishing mill within a range of 700 to 900° C. The upper limit of the total area reduction rate is different depending on factors such as equipment and condition of rolling: for example, in the case of a 5-block mill, rolling is viable under a total area reduction rate of 65%.

Figure 10:
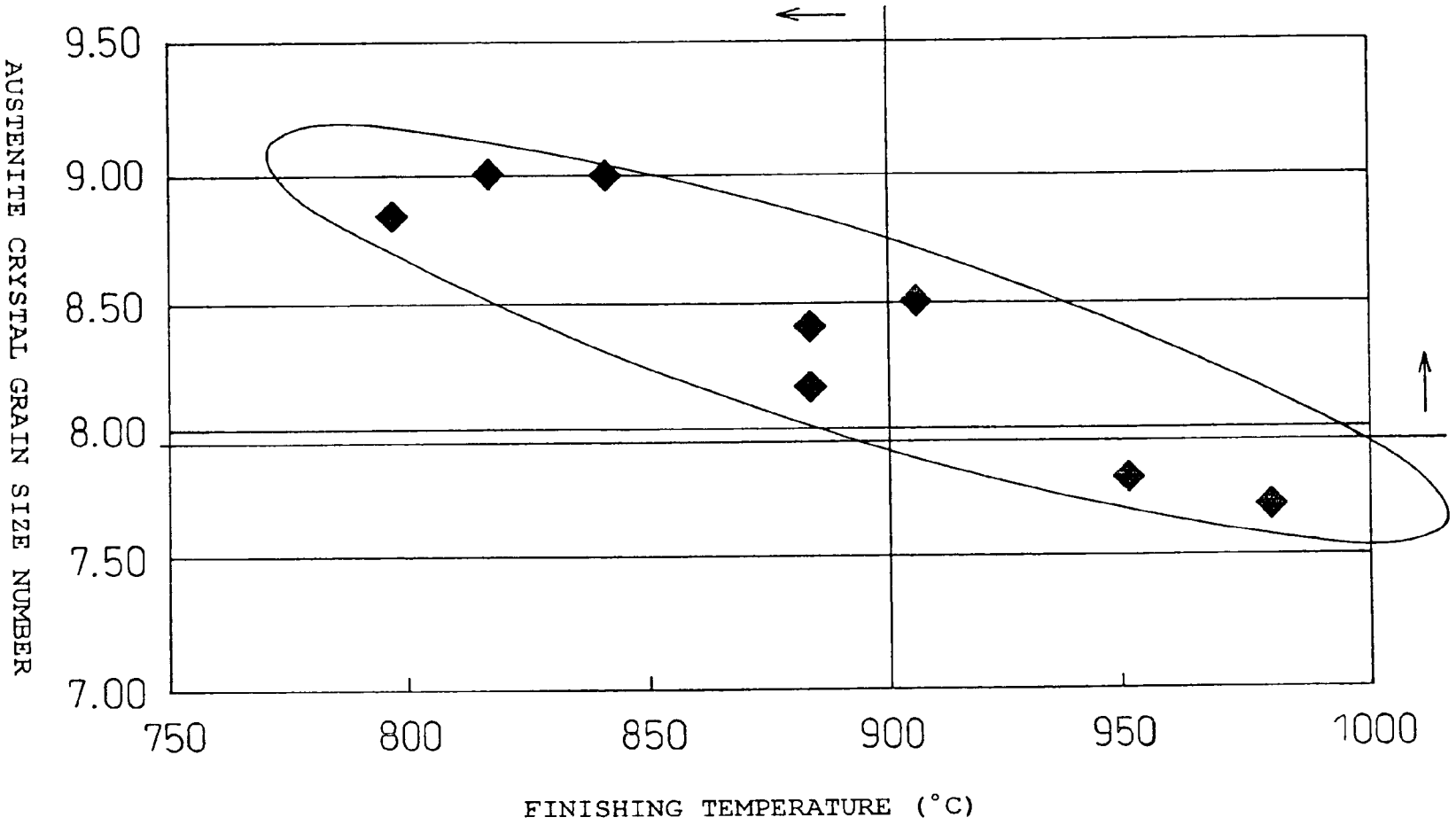
FIG. 10 is another graph showing the relationship between the austenite crystal grain size number and the steel temperature at the entry side of a finishing mill.

FIG. 10 shows the relationship between the austenite crystal grain size number and the steel temperature at the entry side of the finishing mill obtained through tests on a commercial production facility. The tests were carried out on a rolling mill train provided with a 2-stand 3-roll mill at the entry side of its finishing mill. Materials of a steel of grade S45C, under the Japanese Industrial Standard, having a diameter of 45 mm at the entry side of the finishing mill were rolled in these tests under an area reduction rate of 7% each at the 2 passes before the finishing mill and an area reduction rate of 10% each at the preceding and the final finishing passes, the total area reduction rate through all four passes being 30%. According to FIG. 10, it is possible to achieve an austenite crystal grain size number of No. 8 or better, under the Japanese Industrial Standard, by controlling the steel temperature at the entry side of the finishing mill to 900° C. or lower under the above pass schedule.

EXAMPLE

In manufacturing steel bars of carbon steel for machine structure use (S45C under Japanese Industrial Standard) having a diameter of 45 mm by hot rolling, a 2-stand 3-roll finishing mill having the roll caliber arrangement shown in FIG. 3 was used, the steel temperature at the entry side of the preceding pass was controlled to 900° C. and an area reduction rate of 10% was applied at each of the preceding and the final finishing passes. In the roll caliber shapes used therein, the arc radius of the preceding pass caliber was 24.4 mm, the arc radius of the final finishing pass caliber 20.24 mm, the shoulder relief 0.23 mm, and the central angle of the caliber arc 94°. The metallographic structure after the final finish rolling of the bars rolled under the above condition was examined, and it achieved a large grain score of 1 (see FIG. 1), which means that no coarse grains were formed.

As a result of rolling bars using the same finishing mill and controlling the entry temperature to 800° C., a microstructure having an austenite crystal grain size number of No. 8 or better under the Japanese Industrial Standard and uniformly refined grains was obtained. Size deviation was as small as ±0.1 mm or less, showing excellent dimensional accuracy.

Rolling was further carried out after adding a 2-stand 3-roll mill in front of the above finishing mill, by controlling the steel temperature at the entry side of the added 2-stand 3-roll mill to 900° C. and applying an area reduction rate of 7% at each of the 2 passes before the finishing mill and an area reduction rate of 10% at each of the preceding and the final finishing passes of the finishing mill, the total area reduction rate through the 4 passes being 30%. The same roll caliber shapes as specified above were used therein for the preceding and the final finishing passes of the finishing mill. As a result, a microstructure having an austenite crystal grain size number of No. 8 or better under the Japanese Industrial Standard and uniformly refined grains was obtained. Size deviation was as small as ±0.1 mm or less, showing excellent dimensional accuracy.

INDUSTRIAL APPLICABILITY

By the present invention, it is possible to finish hot roll structural steels with high dimension accuracy without causing an abnormal microstructure regardless of inter-stand distances or rolling speed. As a consequence, secondary processors may skip a drawing process since the products are free from bending and other problems caused by an abnormal microstructure. Besides, the secondary processors can reduce costs since the present invention makes on-line manufacturing of products not requiring normalizing and other heat treatments viable by properly controlling the steel temperature at the entry side of the finishing mill.

What is claimed is:

1. A finish hot rolling method for structural steels using a 2-stand 3-roll finishing mill characterized by setting the area reduction rate of the final finishing pass to 10 to 20% and the value of an area reduction rate of the final finishing pass divided by the corresponding area reduction rate of the pass preceding the final finishing pass to 0.7 to 1.3.

2. A finish hot rolling method for structural steels according to claim 1 characterized by forming the arc radius of a roll caliber of the pass preceding the final finishing pass to be 1.0 to 1.3 times the arc radius of the corresponding caliber of the final finishing pass.

3. A finish hot rolling method for structural steels according to claim 1 characterized by forming a caliber of the final finishing pass such that the caliber arc radius is equal to the target radius of the corresponding product, the central angle of the caliber arc is 90 to 100°, and a side wall portion at each side of the caliber extends in a straight line from an end of the caliber arc portion to a roll shoulder.

4. A finish hot rolling method for structural steels according to claim 1 characterized by controlling the steel temperature at the entry side of the finishing mill to 700 to 800° C.

5. A finish hot rolling method for structural steels according to claim 1 characterized by employing a 3-roll mill consisting of 2 or more roll stands in front of the finishing mill, securing a total area reduction rate of 30% or more through all roll stands, and controlling the steel temperature at the entry side of the finishing mill to 700 to 900° C.

* * * * *